US005931037A

United States Patent [19]

Yamada et al.

[11] Patent Number: 5,931,037

[45] **Date of Patent: *Aug. 3, 1999**

[54] YOKE OF PLANETARY GEAR-TYPE STARTER, MANUFACTURING APPARATUS THEREFOR AND MANUFACTURING METHOD THEREOF

[75] Inventors: Yoshiharu Yamada; Kyoichi Okamoto; Yoshihiro Morimoto; Akira Morishita, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,387

[22] Filed: Feb. 4, 1997

[30] Foreign Application Priority Data

Jul. 1, 1996 [JP] Japan ..... 8-171348

[51] Int. Cl.[6] ..... B21D 22/16

[52] U.S. Cl. ..... 72/68; 72/85

[58] Field of Search ..... 72/68, 82, 83, 72/84, 85

[56] References Cited

U.S. PATENT DOCUMENTS

| | | | |
|---|---|---|---|
| 4,488,073 | 12/1984 | Morishita . | |
| 4,520,285 | 5/1985 | Isozumi et al. . | |
| 4,551,122 | 11/1985 | Kraft et al. | 72/83 |
| 4,671,125 | 6/1987 | Yabunaka . | |
| 5,031,296 | 7/1991 | Magnoni | 72/85 |
| 5,619,879 | 4/1997 | Friese | 72/85 |
| 5,806,358 | 9/1998 | Rolf | 72/68 |

FOREIGN PATENT DOCUMENTS

| | | | |
|---|---|---|---|
| 0 605 916 | 7/1994 | European Pat. Off. | 72/83 |
| A-43-27-746 | 2/1995 | Germany . | |
| 63-36945 | 2/1988 | Japan | 72/412 |
| 63-104684 | 7/1988 | Japan . | |

OTHER PUBLICATIONS

DE–P. Industrieanzeiger 38–92, pp. 27 to 29, Sep. 1992.

*Primary Examiner*—Lowell A. Larson
*Attorney, Agent, or Firm*—Sughrue, Mion, Zinn, Macpeak & Seas, PLLC

[57] ABSTRACT

A manufacturing method of a cylindrical yoke including a bottom portion to which an opening 12*a* is formed to journal the starter output shaft of a planetary gear-type starter incorporating a planetary gear reducer, and an inner peripheral gear portion formed to the vicinity of the bottom portion, the yoke functioning as the field magnet of a motor in the planetary gear-type starter. The yoke is formed by subjecting a metal disk 10 to cold spinning. As a result the inner peripheral gear portion of the yoke and a thin portion can be easily formed and miniaturization, reduction in weight and cost reduction are realized.

5 Claims, 5 Drawing Sheets

YOKE OF PLANETARY GEAR-TYPE STARTER, MANUFACTURING APPARATUS THEREFOR AND MANUFACTURING METHOD THEREOF

BACKGROUND OF THE INVENTION

1. Field of the Invention

The present invention relates to a yoke of a planetary gear-type starter incorporating a planetary gear reducer used in, for example, an automobile engine, a manufacturing apparatus therefor and a manufacturing method thereof, and more specifically, to the yoke of a planetary gear-type starter in which the reduction in weight of the yoke can be easily realized, as well as a manufacturing apparatus therefor and a manufacturing method thereof.

2. Description of the Related Art

Conventionally, a planetary gear-type starter incorporates a planetary gear reducer which includes planetary gears as a starter for driving, for example, a crank shaft when an automobile engine is started.

FIG. 7 is a side elevational view, partly in cross section, of a planetary gear-type starter including a conventional yoke arranged integrally with an inner peripheral gear portion.

In FIG. 7, the yoke 1 acting as a field magnet of the motor of the planetary gear-type starter includes an annular inner peripheral gear portion 11 formed to an inner peripheral side adjacent to a bottom portion 12 composed of a thick portion, a bearing 13 engaged in the opening 12*a* of the bottom portion 12 and a cylindrical thin portion 14 formed to an opening side confronting the bottom portion 12.

A flange 2 journaled by the bearing 13 has a plurality of pins 22 standing on the end surface extending in the yoke 1. The respective pins 22 are concentrically disposed to form an arc shape with respect to the center axis of rotation of the flange 2 and each of the pins 22 has a planetary gear 4 rotatably disposed thereto.

The flange 2 constitutes a reducer on the end surface side thereof in cooperation with the inner peripheral gear portion 11 and planetary gears 4. The other end of the flange 2 is fixed to the starter output shaft 21 of the starter so as to transmit the rotational output of a motor output shaft 31 to the starter output shaft 21 through the planetary gear reducer.

An annular projecting portion 12*b* projecting in the axial direction of the starter output shaft 21 is formed to the end surface of the opening 12*a* of the bottom portion 12 so as to secure the length in the axial direction so that the projecting portion holds the bearing 13 by being engaged therewith. With this arrangement, even if the bottom portion 12 is formed to a relatively thin thickness, it is permitted to be engaged with the bearing 13, so that reduction in weight is realized by suppressing the wall thickness of the bottom portion 12.

The extreme end of the starter output shaft 21 is journaled by a bracket 5 covering a front portion, and an overrunning clutch 24 and a pinion gear 25 are disposed at an intermediate portion of the starter output shaft 21 so as to be movable in the axial direction. The bracket 5 is fixed to the outer peripheral end surface of the bottom portion 12 of the yoke 1.

When the starter is operated, the overrunning clutch 24 and the pinion gear 25 move in the direction of the arrow while rotating integrally with the starter output shaft 21, so that they drive a starting object (for example, the crank shaft of an automobile engine) through the gear portion of the outer peripheral side of the pinion gear 25.

The motor which is driven at the time of start includes a rotor or an armature 3 coupled with the motor output shaft 31, a permanent magnet 33 acting as a field magnet device and the yoke 1. The permanent magnet 33 is magnetized in a radial direction and generates flux in the peripheral direction in the yoke 1 acting as a magnetic path forming unit. The motor output shaft 31 coupled with the armature 3 is accommodated in the thin portion 14 of the cylindrical yoke 1. The extreme end of the motor output shaft 31 extends to the vicinity of the bearing 13 in the yoke 1.

The motor output shaft 31 is coaxially accommodated in the flange 2 of the starter output shaft 21 and journaled by the bearing 23 in the flange 2.

The plurality of planetary gears 4 rotatably mounted to the respective pins 22 on the flange 2 are engaged with the outer peripheral gear portion 32 on the motor output shaft 31 and the inner peripheral gear portion 11 of the yoke 1, respectively.

The inner peripheral gear portion 11 of the yoke 1 constitutes the planetary gear reducer in association with the planetary gears 4 on the flange 2 and the motor output shaft 31 engaging each other, and the planetary gear reducer is accommodated on the bottom portion 12 side of the yoke 1. When the starter is operated, the planetary gear reducer reduces the rotation of the motor output shaft 31 through the planetary gears 4 and transmits the reduced rotation to the starting object (crank shaft) through the starter output shaft 21 and the pinion gear 25.

Although not shown in detail, a switching device 6 which is mounted to the bracket 5 and disposed on the yoke 1 incorporates a switching circuit for supplying electric power to the motor in association with a key switch and the like when the starter is operated and a plunger for driving the overrunning clutch 24.

A lever 7, which is rotatably mounted to a rotatable shaft 71 and has one end engaged with the plunger in the switching device 6 and the other end engaged with the overrunning clutch 24, is rotated counterclockwise about the rotatable shaft 71 when the plunger is driven so as to move the overrunning clutch 24 and the pinion gear 25 on the starter output shaft 21 in the direction of the arrow.

Next, operation of the planetary gear-type starter using the conventional yoke 1 shown in FIG. 7 will be described.

First, before the starter is operated, the lever 7 is located in the state shown in FIG. 7, the overrunning clutch 24 is not moved and the pinion gear 25 is not engaged with the crank shaft.

When the starter is operated by turning on the key switch, the armature 3 of the motor which is energized by the electric power supplied from the switching device 6 is rotated by receiving the urging force of the permanent magnet 33 to thereby drive the motor output shaft 31 arranged integrally with the armature 3 in rotation. In addition, the lever 7 which is driven by the plunger in the switching device 6 rotates counterclockwise about the rotatable shaft 71 so as to move the overrunning clutch 24 in the direction of the arrow and causes the pinion gear 25 to be engaged with the crank shaft.

At the same time, the rotational output of the motor is transmitted to the planetary gears 4 from the outer peripheral gear portion 32 of the motor output shaft 31, so that the planetary gears 4 are rotated as well as being turned between the outer peripheral gear portion 32 of the motor output shaft 31 and the inner peripheral gear portion 11 of the yoke 1.

With this operation, the flange 2 to which the planetary gears 4 are rotatably mounted is rotated at a rotational speed which is reduced with respect to the rotational speed of the motor output shaft 31 and the reduced rotational output is transmitted to the starter output shaft 21.

The starter output shaft 21 rotates the crank shaft at the reduced rotational speed through the overrunning clutch 24 and the pinion gear 25.

The manufacturing apparatus and the manufacturing method of the conventional yoke 1 will be described with reference to FIG. 8 and FIG. 9.

FIG. 8 is a side cross sectional view showing a yoke 1 formed using an ordinary cold forging apparatus, and FIG. 9 is a front elevational view showing the state that a bearing 13 is removed from the yoke 1 of FIG. 8 which is viewed from a thin portion 14 side, wherein components denoted by the same numerals are the same as those in the above-mentioned figure (see FIG. 7).

FIG. 8 shows a case that an annular projecting portion 12*b* is not formed to the bottom portion 12 of the yoke 1 because the bottom portion 12 has a wall thickness sufficient to permit the disposition of the bearing 13.

The structure of FIG. 8 can be more easily made than the structure of FIG. 7 in which the annular projecting portion 12*b* is formed. This is because the yoke 1 is conventionally made by cold forging, sintering, sintering forging, injection molding, powder metallurgy and the like, and the formation of the annular projecting portion 12*b* as shown in FIG. 7 increases the number of steps of a manufacturing process.

Many working steps are needed to form the thin portion 14 which is much thinner than the bottom portion 12 by working a yoke material originally having the same wall thickness. In addition, since a degree of working (corresponding to the reduction ratio of a cross section) for forming the thin portion 14 is increased, when cold forging or the like is used in particular, a large amount of pressurizing force is required, by which the life of a tool is deteriorated and the cost is increased.

Further, when sintering and the like is used, it is difficult to fill the thin portion 14 with a predetermined amount of material.

As described above, the conventional yoke of the planetary gear-type starter as well as the manufacturing apparatus therefor and the manufacturing method thereof have problems in that since the yoke is molded using cold forging, sintering and the like, the bottom portion 12 composed of the thick portion and the cylindrical thin portion 14 cannot be easily formed, miniaturization and reduction in weight are not easily realized and a large manufacturing cost is needed to form the thin portion 14.

An object of the present invention made to solve the above problems is to provide a yoke of a planetary gear-type starter in which an inner peripheral gear portion and a thin portion are easily formed and miniaturization, reduction in weight and cost reduction are realized by using cold spinning working, as well as providing a manufacturing apparatus therefor and a manufacturing method thereof.

Another object of the present invention is to provide a yoke of a planetary gear-type starter in which an annular projecting portion is easily formed from an opening by burring working when a disk serving as the metal material of the yoke is mounted to a working tool and miniaturization, reduction in weight and cost are realized in cold spinning working, as well as providing the manufacturing apparatus therefor and the manufacturing method thereof.

SUMMARY OF THE INVENTION

A manufacturing method of a cylindrical yoke according to the present invention including a bottom portion in which an opening is formed to journal a starter output shaft of a planetary gear-type starter incorporating a planetary gear reducer, and an inner peripheral gear portion formed in the vicinity of the bottom portion and functioning as a field magnet of a motor in th planetary gear-type starter, the manufacturing method comprising the step of subjecting a disk composed of a metal material to cold spinning to form the cylindrical yoke.

A manufacturing method of a yoke of a planetary gear-type starter according to the present invention further comprises the step of subjecting the disk to burring at the center thereof so as to form an annular projecting portion projecting from an end surface of the opening of the yoke in the axial direction of the starter output shaft when the disk is mounted to working tools for carrying out the cold spinning.

A manufacturing method of a yoke of a planetary gear-type starter according to the present invention is such that the disk has an initial opening formed at the center thereof and the burring step is carried out by clamping the disk between a first tool having a cylindrical convex portion with an outside diameter corresponding to the opening an which is larger than the initial opening, and a second tool having a cylindrical concave portion into which the cylindrical convex portion is inserted so as to permit the cylindrical convex portion to be inserted into the initial opening and the cylindrical concave portion.

A manufacturing method of a yoke of a planetary gear-type starter according to the present invention is such that the burring step comprises a first step of disposing the disk by aligning it with the first tool so that the initial opening is aligned with the cylindrical convex portion and a second step of moving the second tool in an axial direction to permit the cylindrical convex portion to be inserted into the cylindrical concave portion of the second tool and pressing the end surface of the second tool against the end surface of the first tool while clamping the metal material of the yoke. A spinning step comprises a third step of rotating the first and second tools and a roller in an opposite direction from each other, clamping the disk between the roller and the first tool while bending the disk and moving the roller in the axial direction from the end surface of the first tool while pressing the roller against the outer periphery of the first tool. A plurality of recesses are formed on the inner surface of the bottom portion of the yoke by a plurality of convex portions on the end surface of the first tool in the second step, and the inner peripheral gear portion of the yoke is formed by a toothed portion disposed at the outer periphery in the vicinity of the end surface of the first tool in the third step.

A manufacturing method of a yoke of a planetary gear-type starter according to the present invention is such that a diametrically reduced portion is formed at the outer periphery of the yoke corresponding to the inner peripheral gear portion at the third step.

A manufacturing apparatus according to the present invention for a cylindrical yoke including a bottom portion to which an opening is formed to journal a starter output shaft of a planetary gear-type starter incorporating a planetary gear reducer, a plurality of recesses formed to an inner surface of the bottom portion and an inner peripheral gear portion formed in the vicinity of the bottom portion and functioning as a field magnet of a motor in the planetary gear-type starter, the manufacturing apparatus comprising a first rotatable tool having an outer peripheral shape corresponding to the inner surface shape of the yoke, a second rotatable tool confronting the end surface of the first tool while clamping a material corresponding to the bottom portion of the yoke and a roller confronting the outer peripheral surface of the first tool while clamping a material corresponding to the cylindrical portion of the yoke as well as being axially movable from the end surface of the first tool, wherein the first tool comprises a cylindrical convex portion projecting from the center of the end surface, a plurality of convex portions disposed at the end surface around the cylindrical convex portion and a toothed portion disposed at the outer peripheral side in the vicinity of the end surface, and the second tool comprises a cylindrical concave portion, into which the cylindrical convex portion is inserted, located at the center of a surface confronting the end surface of the first tool, wherein the outside diameter of the cylindrical convex portion of the first tool corresponds to the inside diameter of the opening of the yoke, the convex portions on the end surface of the first tool correspond to the recesses on the bottom portion of the yoke and the toothed portion of the first tool corresponds to the inner peripheral gear portion of the yoke.

A yoke according to the present invention functioning as a field magnet of a motor in a planetary gear-type starter incorporating a planetary gear reducer comprises a cylindrical thin portion for accommodating the armature of the motor, a bottom portion composed of a thick portion to which an opening for journaling the starter output shaft of the planetary gear-type starter is formed, an inner peripheral gear portion formed in the vicinity of the bottom portion, another bottom portion composed of another thick portion and formed to an end surface in the vicinity of the inner peripheral gear portion, and a plurality of recesses formed to the inner surface of the bottom portion.

A yoke of a planetary gear-type starter according to the present invention is arranged such that a diametrically reduced portion is formed at the outer periphery of the yoke corresponding to the inner peripheral gear portion.

DESCRIPTION OF THE PREFERRED EMBODIMENT

Embodiment 1

An embodiment 1 of the present invention will be described below with reference to the drawings.

Figure 1:
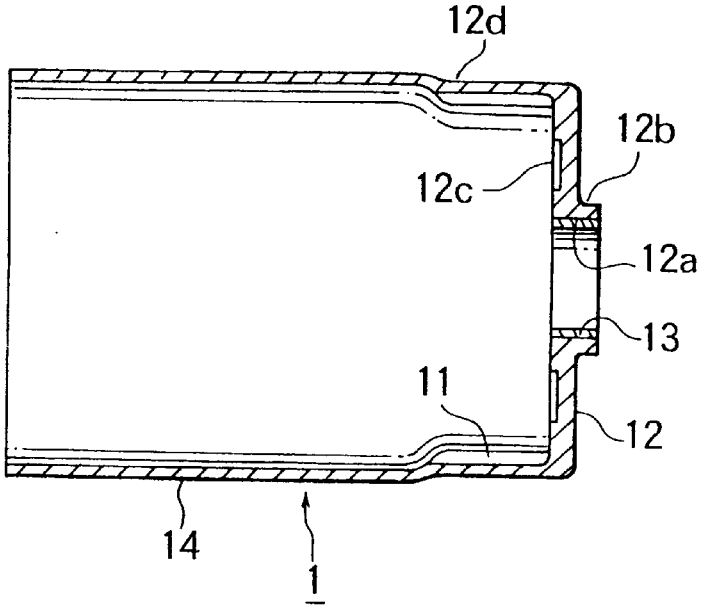
FIG. 1 is a side cross sectional view showing a yoke of a planetary gear-type starter according to an embodiment 1 of the present invention.
Figure 2:
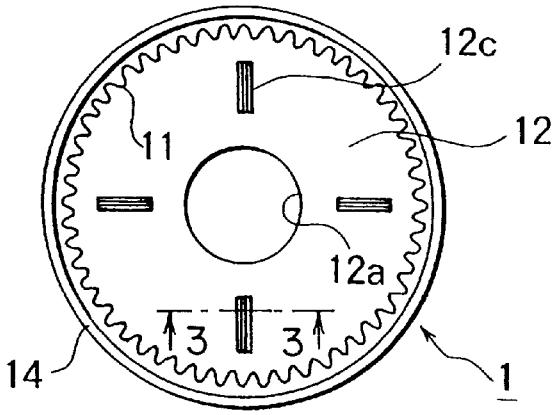
FIG. 2 is a front elevational view of the yoke in FIG. 1 when it is viewed from a thin portion side.
Figure 3:
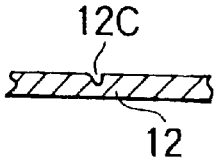
FIG. 3 is a partly cross sectional view taken along the line 3—3 of the yoke of FIG. 2.

FIG. 1 is a side elevational view showing a yoke 1 according to an embodiment 1 of the present invention, FIG. 2 is a front elevational view showing the state that a bearing 13 is removed from the yoke 1 in FIG. 1 when it is viewed from a thin portion 14 side and FIG. 3 is a cross sectional view taken along the line 3—3 of FIG. 2.

Figure 8:
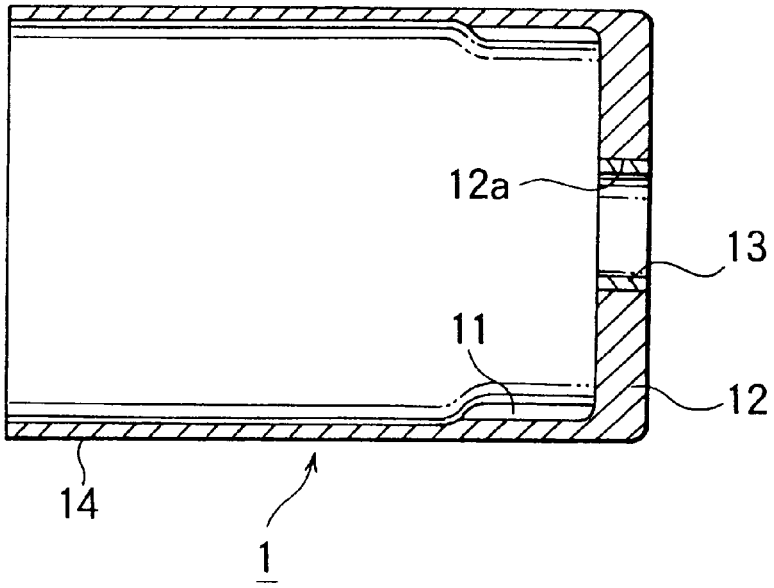
FIG. 8 is a side cross sectional view showing the conventional yoke.
Figure 9:
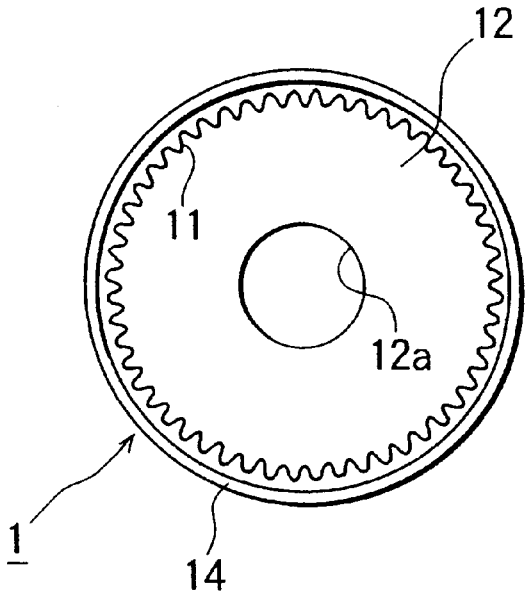
FIG. 9 is a front elevational view of the yoke of FIG. 8 when it is viewed from a thin wall side.

In the respective drawings, the same components as those in the above-mentioned figures (see FIG. 8 and FIG. 9) are denoted by the same numerals as used therein and the description thereof is omitted.

Further, the arrangement and operation of a planetary gear-type starter including the yoke 1 of the embodiment 1 of the present invention are not described here because they are the same as described above (see FIG. 7).

In this case, the yoke 1 includes not only an annular projeting portion 12*b* projecting from the end surface of an opening 12*a* in the axial direction of a starter output shaft 21 (see FIG. 7), but also a plurality of recesses 12*c* formed in the inner surface of a bottom portion 12 and a diametrically reduced portion 12*d* formed at the outer peripheral surface of an inner peripheral gear portion 11.

Figure 7:
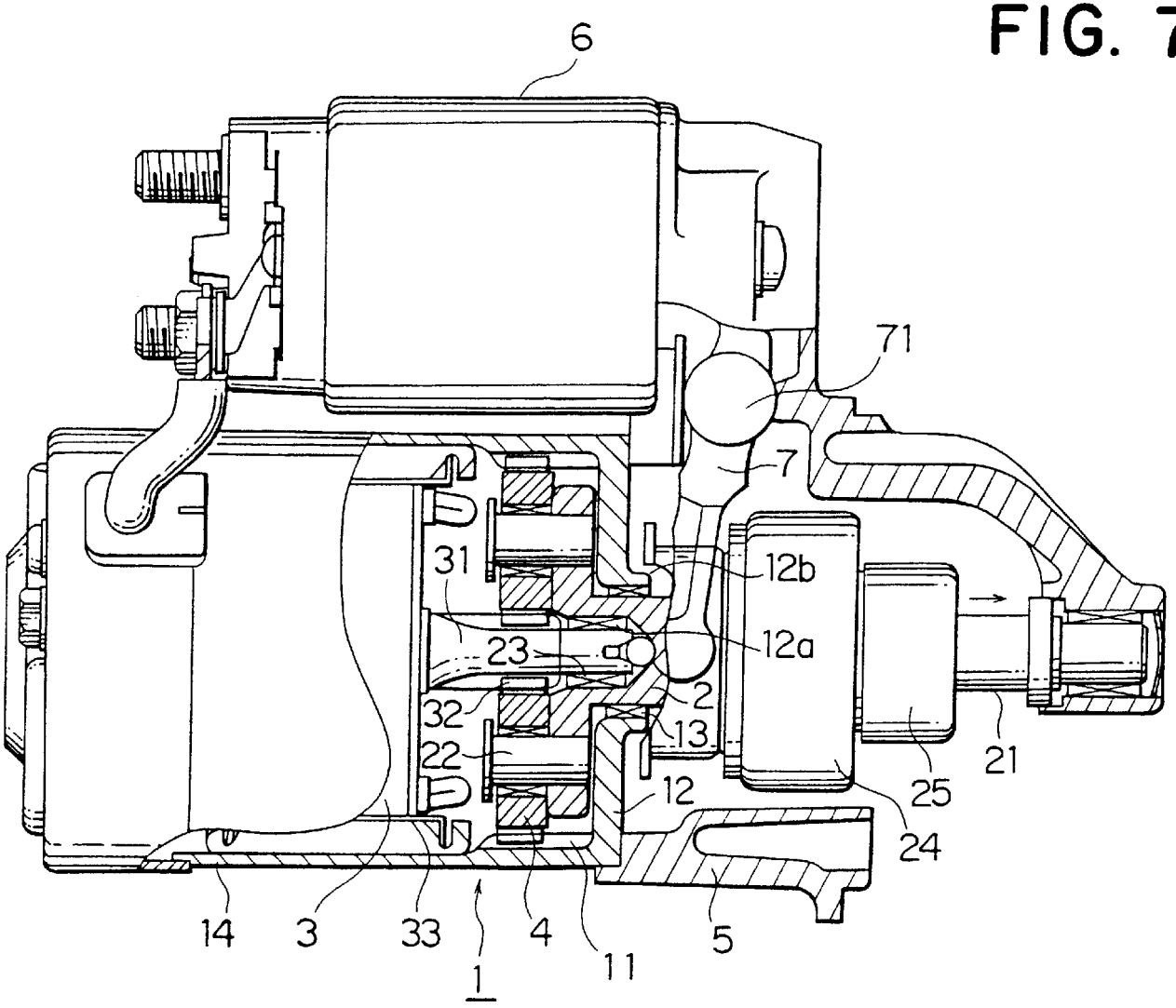
FIG. 7 is a side elevational view, partly in cross section, of a planetary gear-type starter using a conventional yoke.

When the starter is assembled as shown in FIG. 7, the recesses 12*c* on the bottom portion 12 can hold lubricant such as grease or the like.

Further, the formation of the diametrically reduced portion 12*d* in correspondence to the inner peripheral gear portion 11 permits a yoke material to sufficiently flow to the inner peripheral gear portion 11 so that the accuracy of the inner peripheral gear portion 11 can be secured.

A manufacturing apparatus and a manufacturing method of the yoke 1 according to the embodiment 1 of the present invention shown in FIG. 1–FIG. 3 will be described below with reference to FIG. 4–FIG. 6.

Figure 4:
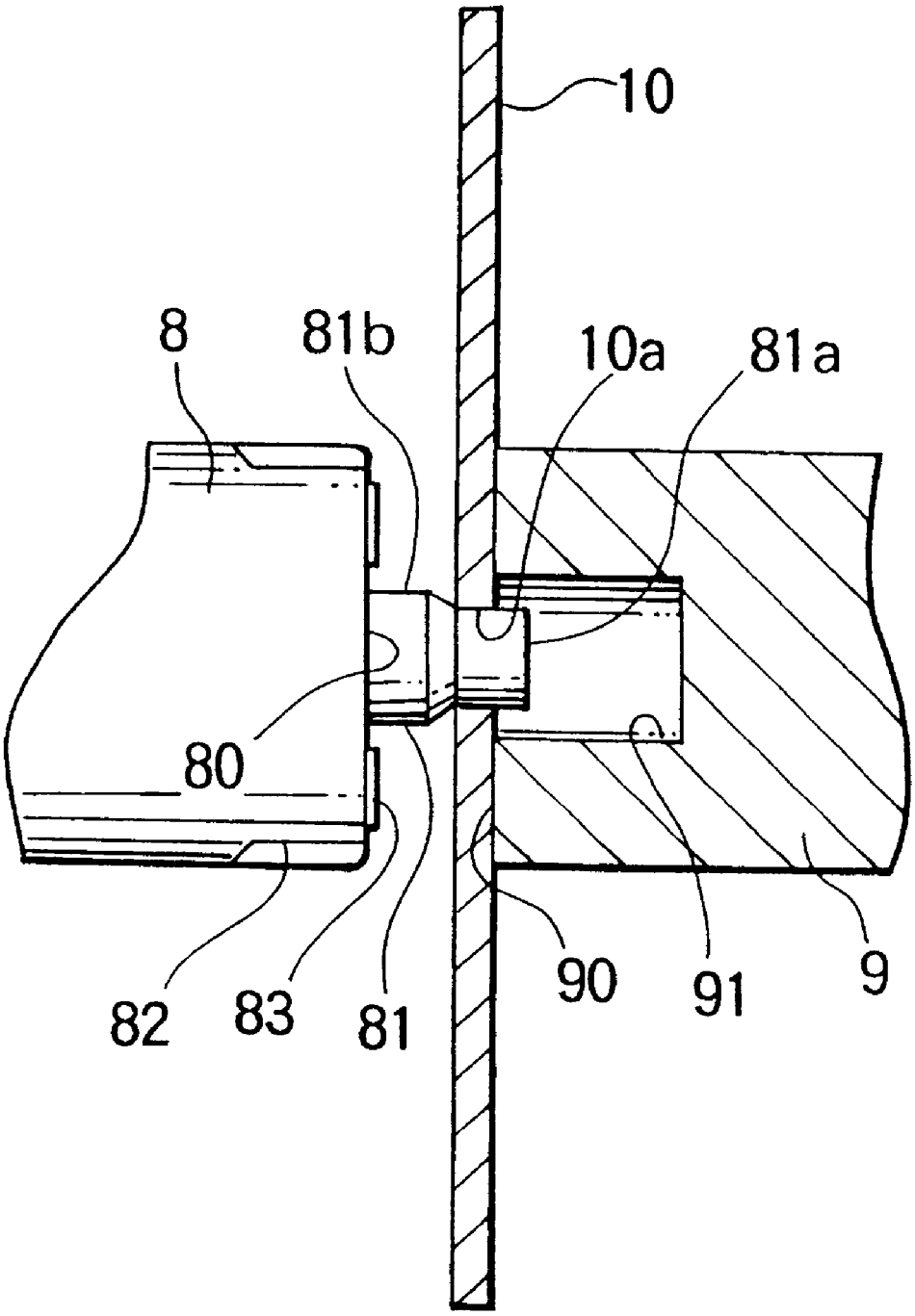
FIG. 4 is a side cross sectional view showing the state of the yoke of the planetary gear-type starter according to the embodiment 1 of the present invention at the first step of a yoke manufacturing apparatus.
Figure 5:
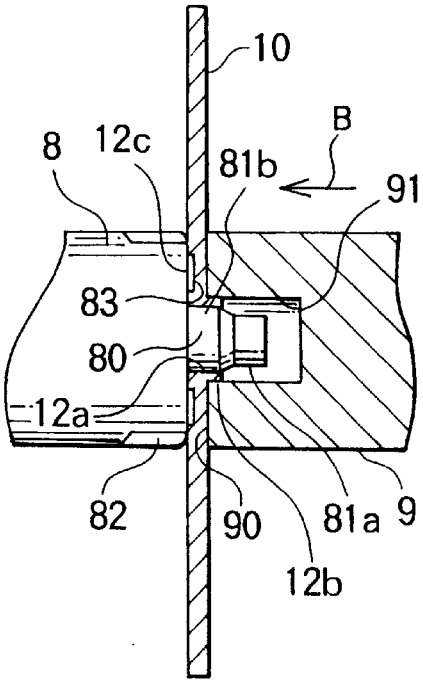
FIG. 5 is a side cross sectional view showing the state of the yoke of the planetary gear-type starter according to the embodiment 1 of the present invention at the second step of the yoke manufacturing apparatus.
Figure 6:
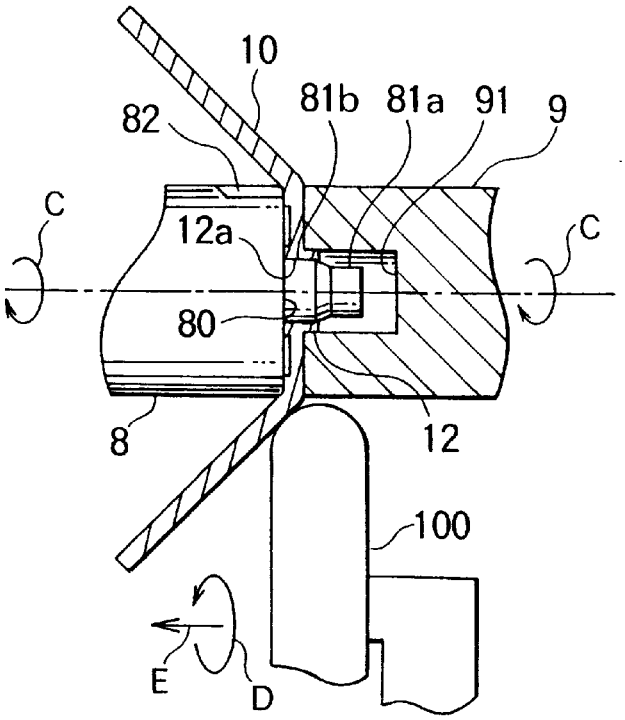
FIG. 6 is a side cross sectional view showing the state of the yoke of the planetary gear-type starter according to the embodiment 1 of the present invention at the third step of the yoke manufacturing apparatus.

FIG. 4–FIG. 6 are side cross sectional views showing the manufacturing apparatus of the yoke 1 according to the embodiment 1 of the present invention and correspond to respective steps when the yoke 1 is made.

In FIG. 4–FIG. 6, a fixedly disposed first tool 8 has an outer peripheral shape corresponding to the inner peripheral shape of the yoke 1 (see FIG. 1).

A second tool 9 movable in an axial direction (direction of an arrow B) has an end surface 90 corresponding to the end surface 80 of the first tool 8 and clamps a disk 10 acting as the metal material of the yoke 1 at the central portion thereof corresponding to the bottom portion 12 of the yoke 1.

The first tool 8 coaxially confronts the second tool 9 when the disk 10 is worked and they rotate in the direction of an arrow C in the state that they clamp the disk 10 (see FIG. 6).

When the disk 10 is subjected to spinning working, a roller 100 which is pressed against the side of the first tool 8 in the state that the disk 10 is clamped rotates in the direction of an arrow D (opposite to the arrow C) as well as linearly moves from the end surface 80 of the first tool 8 in the direction of an arrow E (axial direction).

The first tool 8 includes a cylindrical convex portion 81 projecting from the center of the end surface 80, a toothed portion 82 disposed at the outer periphery thereof in the vicinity of the end surface 80 and a plurality of convex portions 83 disposed at the end surface 80 positioned in the vicinity of the cylindrical convex portion 81.

Further, the second tool 9 includes a cylindrical concave portion 91 located at the center of the end surface 90 thereof confronting the end surface 80 of the first tool 8 and the cylindrical convex portion 81 is inserted into the cylindrical concave portion 91.

The cylindrical convex portion 81 of the first tool 8 includes a diametrically reduced tip portion 81*a* and a diametrically enlarged portion 81*b* formed rearward of the diametrically reduced tip portion 81*a*. The outside diameter of the diametrically enlarged portion 81*b* is larger than the initial opening 10*a* of the disk 10 acting as the yoke material before it is worked and corresponds to the inside diameter of the opening 12*a* of the yoke 1 after it is worked.

The convex portions 83 on the end surface 80 of the first tool 8 are disposed to securely hold the disk 10 between them and the second tool 9 in working. Further, the convex portions 83 correspond to the recesses 12*c* on the bottom portion 12 of the yoke 1 and the toothed portion 82 of the first tool 8 corresponds to the inner peripheral gear portion 11 of the yoke 1 after the working.

Note, the wall thickness of the disk 10 is previously set to a necessary minimum value in consideration of the wall thickness of the inner peripheral gear portion 11 of the yoke 1 and the bottom portion 12 when they are worked and after they are completed and for the purpose of miniaturization and reduction in weight.

First, the disk 10 is aligned with the first tool 8 and disposed so that the position of the initial opening 10*a* of the disk 10 coincides with the position of the diametrically reduced tip portion 81*a* of the cylindrical convex portion 81 of the first tool 8 as shown in FIG. 4 (first step).

At the time, the second tool 9 is aligned so as to be coaxially disposed to the first tool 8 in confrontation therewith.

Next, the second tool 9 is moved in the direction of the arrow B (axis) so that the cylindrical convex portion 81 of the first tool 8 is inserted into the cylindrical concave portion 91 of the second tool 9 and the end surface 90 of the second tool 9 is pressed against the end surface 80 of the first tool 8 while clamping the disk 10 as the yoke material as shown in FIG. 5 (second step 2).

At the same time, the initial opening 10*a* of the disk 10 is expanded along the outside diameter of the diametrically enlarged portion 81*b* by burring molding based on the engagement of the cylindrical convex portion 81 with the cylindrical concave portion 91, thus the final opening 12*a* of the yoke 1, as well as the annular projecting portion 12*b* projecting from the end surface of the opening 12*a* are formed.

Further, the recesses 12*c* are formed on the disk 10 which corresponds to the bottom portion 12 by the convex portions 83 on the end surface 80 of the first tool 8.

As described above, the convex portions 83 of the first tool 8 pressed into the disk 10 permit the disk 10 to be rotated integrally with the first tool 8 and the second tool 9 in a third step to be described later.

Subsequently, the first tool 8 and the second tool 9 are rotated in the direction of the arrow C and the roller 100 is rotated in the direction of the arrow D, so that the first tool 8 and the second tool 9 are rotated in the direction opposite to that of the roller 100 as shown in FIG. 6.

At the same time, the roller 100 is moved in the direction of an arrow E (axis) from the end surface 80 of the first tool 8 while clamping the disk 10 as the yoke material and pressing the roller 100 against the outer periphery of the first tool 8 (the third step).

With this operation, cold spinning working is carried out so that the disk 10 is bent in the axial direction as well as rolled.

Therefore, the disk 10 is formed to the cylindrical portion or the diametrically reduced portion 12*d* of the yoke 1 and the thin portion 14 by tracing the outside diametrical shape of the first tool 8 (see FIG. 1).

At the time, since the diametrically reduced portion 12*d* is formed by squeezing the yoke material, even if the yoke material has a minimum thickness, it sufficiently enters the toothed portion 82 so as to enhance the accuracy of the inner peripheral gear portion 11.

Since the cold spinning working can be carried out with a relatively small pressure, the manufacturing apparatus is small in size and economical, thus miniaturization and reduction in weight can be easily realized with a small power consumption.

Since the burring molding is carried out when the respective tools 8 and 9 are mounted prior to the spinning working, not only the yoke 1 but also the opening 12*a* and the annular projecting portion 12*b* can be formed by a single working process.

Therefore, an axial length which permits the insertion of the bearing 13 into the opening 12*a* can be sufficiently secured using a relatively thin yoke material, thus miniaturization and reduction in weight can be easily realized.

Since the relatively thin yoke material is applicable, the thin portion 14 can be easily formed without the need of a long rolling time.

Further, the recesses 12*c* formed by the convex portions 83 for preventing the slip of the disk 10 in working can effectively hold lubricant such as grease or the like after the completion of the yoke 1.

Note, although the convex portions 83 are disposed to the end surface of the first tool 8 in the embodiment 1, they may be omitted when no difficulty is caused when the disk 10 is mounted in the cold spinning working.

Although the lubricant holding recesses 12*c* are not formed on the inner surface of the bottom portion 12 in this case, the recesses 12*c* may be formed in another process if they are necessary.

The annular projecting portion 12*b* is formed to the end surface of the opening 12*a* of the yoke 1 by the burring working when the disk 10 is mounted to the working tools. However, since the annular projecting portion 12*b* can be omitted when the wall thickness of the bottom portion 12 (corresponding to the thickness of the disk 10 as the yoke material) is sufficiently large to permit the engagement of the bearing 13 with the bottom portion 12, the burring working becomes also unnecessary.

Although the diametrically reduced portion 12*d* is disposed at the outer periphery corresponding to the inner peripheral gear portion 11, when the wall thickness of the disk 10 as the yoke material is sufficiently large to form the inner peripheral gear portion 11, the diametrically reduced portion 12*d* may be omitted.

Further, although the embodiment 1 shows an example of the cold spinning and the burring as the manufacturing apparatus and the manufacturing method for molding the yoke 1, it is needless to say that similar functions and advantages can be achieved by carrying out a modification of another cold spinning working and burring working.

The yoke and the manufacturing method of the yoke of the present invention are advantageous since the inner peripheral gear portion, the thin portion the annular projecting portion, and the recesses can be easily and securly formed, and miniaturization, reduction in weight and cost reduction are realized.

What is claimed is:

1. A manufacturing method of a cylindrical yoke including a bottom portion in which an opening is formed to journal a starter output shaft of a planetary gear-type starter incorporating a planetary gear reducer, and an inner peripheral gear portion formed in the vicinity of the bottom portion, the yoke functioning as a field magnet of a motor in the planetary gear-type starter, said method comprising the step of subjecting a disk comprising a metal material to cold spinning to form the cylindrical yoke, and further comprising clamping the disk with a first tool and a second tool, the first tool having a cylindrical convex portion and the second tool having a cylindrical concave portion into which said cylindrical convex portion is inserted in said clamping step to form an integral annular projecting portion of the yoke.

2. A manufacturing method of a yoke of a planetary gear-type starter according to claim 1, wherein the disk has an initial opening formed at the center thereof and the cylindrical convex portion of the first tool has an outside diameter larger than said initial opening, wherein the cylindrical convex portion is inserted into said initial opening and said cylindrical concave portion.

3. A manufacturing method of a yoke of a planetary gear-type starter according to claim 2, further comprising:

a first step of disposing the disk by aligning it with said first tool so that said initial opening is aligned with said cylindrical convex portion; and a second step of moving said second tool in an axial direction to permit said cylindrical convex portion to be inserted into the cylindrical concave portion of said second tool and pressing an end surface of said second tool against an end surface of said first tool while clamping the metal material of the yoke, and said spinning step comprises:

a third step of rotating said first and second tools in a first direction and a roller in a second, opposite direction, clamping the disk between said roller and said first tool while bending the disk and moving said roller in an axial direction of the first tool from the end surface of said first tool while pressing said roller against an outer periphery of said first tool, wherein:

a plurality of recesses are formed on an inner surface of a bottom portion of the yoke by a plurality of convex portions on the end surface of said first tool in said second step; and the inner peripheral gear portion of the yoke is formed by a toothed portion disposed on the outer periphery in the vicinity of the end surface of said first tool in said third step.

4. A manufacturing method of a yoke of a planetary gear-type starter according to claim 3, further comprising forming a diametrically reduced portion of the yoke corresponding to said inner peripheral gear portion in said third step.

5. A manufacturing apparatus for a cylindrical yoke including a bottom portion to which an opening is formed to journal a starter output shaft of a planetary gear-type starter incorporating a planetary gear reducer, a plurality of recesses formed in an inner surface of said bottom portion and an inner peripheral gear portion formed in the vicinity of the bottom portion, the yoke functioning as a field magnet of a motor in the planetary gear-type starter, comprising:

a first rotatable tool having an outer peripheral shape corresponding to an inner surface shape of the yoke;

a second rotatable tool confronting an end surface of said first tool while clamping a material corresponding to the bottom portion of the yoke; and a roller confronting an outer peripheral surface of said first tool while clamping a material corresponding to a cylindrical portion of the yoke and being axially movable from the end surface of said first tool, wherein, said first tool comprises:

a cylindrical convex portion fixed relative to and projecting from the center of said end surface;

a plurality of convex portions disposed on said end surface around said cylindrical convex portion; and a toothed portion disposed on the outer peripheral surface in the vicinity of said end surface; and said second tool comprises:

a cylindrical concave portion, into which said cylindrical convex portion is inserted, located at the center of a surface confronting the end surface of said first tool, wherein, the outside diameter of the cylindrical convex portion of said first tool corresponds to the inside diameter of the opening in the bottom portion of the yoke;

the convex portions on the end surface of said first tool correspond to the recesses in the bottom portion of the yoke; and the toothed portion of said first tool corresponds to the inner peripheral gear portion of the yoke.

* * * * *